US005614464A

United States Patent [19]

Kung

[11] Patent Number: 5,614,464

[45] Date of Patent: Mar. 25, 1997

[54] DYE-RECEIVING ELEMENT FOR THERMAL DYE TRANSFER HAVING IMPROVED WRITEABILITY

[75] Inventor: Teh-Ming Kung, Rochester, N.Y.

[73] Assignee: Eastman Kodak Company, Rochester, N.Y.

[21] Appl. No.: 575,746

[22] Filed: Dec. 20, 1995

[51] Int. Cl.[6] ..... B41M 5/035; B41M 5/38

[52] U.S. Cl. ..... 503/227; 428/195; 428/341; 428/421; 428/422; 428/447; 428/913; 428/914

[58] Field of Search ..... 8/471; 428/195, 428/421, 422, 447, 913, 914, 341; 503/227

[56] References Cited

U.S. PATENT DOCUMENTS

| | | | |
|---|---|---|---|
| 5,260,257 | 11/1993 | Eguchi et al. | 503/227 |
| 5,369,077 | 11/1994 | Harrison et al. | 503/227 |

FOREIGN PATENT DOCUMENTS

| | | |
|---|---|---|
| 61-106293 | 5/1986 | Japan . |
| 61-199997 | 9/1986 | Japan . |

*Primary Examiner*—B. Hamilton Hess
*Attorney, Agent, or Firm*—Harold E. Cole

[57] ABSTRACT

A dye-receiving element comprising a support having thereon a dye image-receiving layer, the dye image-receiving layer containing a polysiloxane and having a perfluorinated alkyl sulfonamide ester copolymer associated therewith in an amount of at least about 0.001 g/m$^2$, the perfluorinated alkyl sulfonamide ester copolymer having the following general structure:

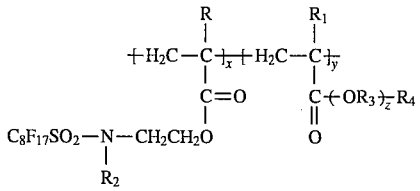

wherein:

R and $R_1$ can each independently represent hydrogen or methyl;

$R_2$ is an alkyl group having from 1 to about 6 carbon atoms;

each $R_3$ is an alkyl group having from 2 to about 4 carbon atoms;

$R_4$ is hydrogen or an alkyl group having from 1 to about 4 carbon atoms;

x is an integer of from 1 to about 5;

y is an integer of from 1 to about 5; and z is an integer of from 1 to about 25.

15 Claims, No Drawings

DYE-RECEIVING ELEMENT FOR THERMAL DYE TRANSFER HAVING IMPROVED WRITEABILITY

This invention relates to dye-receiving elements used in thermal dye transfer, and more particularly to a receiving element containing a polysiloxane and a perfluorinated alkyl sulfonamide ester copolymer in the outermost layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving, element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements used in thermal dye transfer generally comprise a polymeric dye image-receiving layer coated on a base or support.

JP 61/199,997, JP 61/106,293 and U.S. Pat. No. 5,260,257 disclose the incorporation of silicone-containing materials in the form of polymeric binders and/or surfactants into the top layer of multilayer thermal dye transfer receiver elements to prevent undesirable donor/receiver sticking and to enhance coating uniformity.

However, them is a problem with the addition of silicone-containing materials to the receiver overcoat layer in that writeability, such as using felt-tipped pens, on the surface layer is considerably reduced.

It is an object of this invention to provide a dye image-receiving element containing a polysiloxane in the outermost layer which has improved surface writeability.

This and other objects are achieved in accordance with the invention, which comprises a dye-receiving element comprising a support having thereon a dye image-receiving layer, the dye image-receiving layer containing a polysiloxane and having a perfluorinated alkyl sulfonamide ester copolymer associated therewith in an amount of at least about 0.001 g/m$^2$, the perfluorinated alkyl sulfonamide ester copolymer having the following general structure:

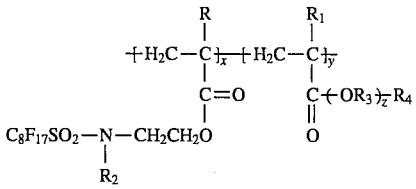

wherein:

R and $R_1$ can each independently represent hydrogen or methyl;

$R_2$ is an alkyl group having from 1 to about 6 carbon atoms;

each $R_3$ is an alkyl group having from 2 to about 4 carbon atoms;

$R_4$ is hydrogen or an alkyl group having from 1 to about 4 carbon atoms;

x is an integer of from 1 to about 5;

y is an integer of from 1 to about 5; and z is an integer of from 1 to about 25.

Materials belonging to the above class of compounds are commercially available from the 3M Corp. under tradenames such as Fluorad®FC-430, FC-431, or FC-740. These materials can be incorporated into the dye-receiving layer or a topcoat layer thereover.

In a preferred embodiment of the invention, in the above formula: R, $R_1$ and $R_4$ are each hydrogen, $R_2$ is butyl, $R_3$ is ethyl or isopropyl, and x, y and z are each 1. This material is believed to be Fluorad®FC-430. In another preferred embodiment of the invention, R and $R_4$ are each methyl, $R_1$ is hydrogen, $R_2$ and $R_3$ are each ethyl, x is 2, y is 1 and z is about 14. This material is believed to be Fluorad®FC-431.

By use of the invention, it was unexpectedly found that the addition of certain fluorinated alkyl ester suffactants to the top layer of a silicone-containing thermal dye transfer receiver element results in distinct improvements in surface writeability.

The dye image-receiving layer of the receiving elements of the invention may comprise, for example, a polycarbonate, a polyurethane, a polyester, polyacrylate, poly(vinyl chloride), vinyl chloride/vinyl acetate copolymers, poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657 of Harrison et al., the disclosure of which is incorporated by reference.

The polysiloxane which is present in the dye-receiving layer may be any such polysiloxane commonly added by those skilled in the art to a dye-receiving element, such as, for example, those materials disclosed in JP 61/199,997, JP 61/106,293 and U.S. Pat. No. 5,260,257, the disclosures of which are hereby incorporated by reference. Examples of these materials include is polydimethylsiloxane polymers and copolymers, amino-modified silicones, epoxy-modified silicones, etc. These polysiloxanes may be present in the dye-receiving layer in amounts ranging from about 0.001 to about 10 g/m$^2$.

The support for the dye-receiving element of the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Dye-donor elements that are used with the dye-receiving element of the invention conventionally comprise a support having thereon a dye layer comprising a dye dispersed in a binder. Any dye can be used in the dye-donor employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises imagewise heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP040MCS-001), a TDK Thermal Head F415HH7-1089 or a Rohm Thermal Head KE 2008-F3. Alternatively, other known sources of energy for thermal dye transfer may be used such as lasers.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

A subbing layer coating solution was prepared by dissolving Prosil®221 and Prosil®2210 surfactants (PCR Corp.), (each at 0.055 g/m$^2$) which are amino-functional organo-oxysilanes, in an ethanol/methanol/water solvent mixture. The resulting test solution contained approximately 1% silane component, 1% water, and 98% 3A alcohol. This solution was coated onto a support of Oppalyte® polypropylene-laminated paper support with a lightly $TiO_2$-pigmented polypropylene skin (Mobil Chemical Co.) at a total dry coverage of 0.11 g/m$^2$. Prior to coating, the support had been subjected to a corona discharge treatment at approximately 450 joules/m$^2$.

The above subbing layer test sample was over-coated with a dye-receiving layer containing Makrolon®KL3-1013 (a polyether-modified bisphenol-A polycarbonate) block copolymer (Bayer AG) (1.82 g/m$_2$), Lexan®141-112 bisphenol-A polycarbonate (General Electric Co.) (1.49 g/m$_2$), and Fhlorad®FC-431, a perfluorinated alkyl sulfonamidoalkyl ester surfactant (3M Corp.) (0.011 g/m$^2$), di-n-butyl phthalate (DBP) (0.33 g/m$^2$), and diphenyl phthalate (DPP) (0.33 g/m$^2$), all coated from a 4:1 methylene chloride/trichloroethylene solvent mixture (4.1% solids).

This dye-receiving layer was then overcoated with the test surfactant solutions in a methylene chloride/trichloroethylene solvent mixture comprising a polycarbonate random terpolymer of bisphenol-A (50 mole-%), diethylene glycol (93.5 wt-%) (ave. mol. wt. 100,000), and polydimethylsiloxane (6.5 wt-%) (2500 MW) block units (50 mole-%) (0.22 g/m$^2$). The amount of surfactant in the overcoat was 0.022 g/m$^2$ for all samples.

The various surfactants tested in this experimental series included silicones and perfluorinated surfactants of various kinds. Examples of control silicone surfactants used were the Dow-Corning Corp. silicone fluids: DC 190, DC 200, DC 510 and DC 1248; General Electric Co. silicone fluids: SF-1023, SF-1080 and SF-1188; and Union Carbide Corp. silicone fluids: L-700 and L-7230.

Control perfluorinated surfactants employed were Zonyl®FSO-100 (DuPont Co.), which is a perfluoroalkyl polyalkylene oxide (not a perfluorinated ester copolymer of the invention) having the formula:

$C_nF_{2n+1}CH_2CH_2O(CH_2O)_xH$, where n=3~8; and Fluorad®FC-171 (3M Co.)

which is a perfluoroalkyl alkoxylate (not a perfluorinated ester copolymer of the invention) having the formula $C_8F_{17}SO_2N(C_2H_5)(CH_2CH_2O)_xCH_3$. Surfactants according to the invention which were employed were: Fluorad®FC-430, FC-431, and FC-740 (3M Co.).

The multilayer thermal dye transfer receiver elements with different suffactants in their respective overcoats were subjected to writeability evaluation by using several commercially available marking pens differing in their solvent compositions as shown in the following table:

TABLE 1

| Marking Pen | Ink Composition | |
|---|---|---|
| (Manufacturer) | Major Solvents | Minor Solvents |
| Sharpie permanent marker (Sanford Co.) | 2-ethoxyethanol | ethanol, methylene chloride, tetrahydrofuran, 1-propanol, 2-butoxyethanol |
| Stabilo OHPen96 overhead projection pen (Schwan-Stabilo, Inc.) | ethanol, butanol, methylene chloride | tetrahydrofuran, 1,2-propanediol |
| Vis-a-Vis overhead projection pen (Sanford Co.) | methylene chloride | tetrahydrofuran 1,2-propanediol |

The writeability of each thermal dye transfer receiver sample so prepared was evaluated by writing strokes on the individual receiver surface and then observing the ink spreading quality under a magnifying eye loupe (7x). The sharper (or more defined) the edge of the strokes and the higher the inking density on the receiver surface were, the better the ink wetting/spreading quality, or better surface writeability was obtained.

The results of the surface writeability evaluation were qualitatively ranked into four categories, i.e.;

poor: non-uniform ink spreading (basically ink doesn't wet), ragged edge, and poor inking density fair: fair ink spreading, fair edge, fair inking density good: good ink spreading, somewhat rounded edge, good inking density excellent: very uniform ink spreading, well-defined sharp edge, and high inking density An acceptable performance is defined as when all pens have at least a "fair" surface writeability evaluation. The writeability test results are summarized in the following Table:

TABLE 2

| Sample | Surfactants used in Topcoat ($g/m^2$) | Surface Writeability Evaluation Marking Pen | | |
|---|---|---|---|---|
| | | Sharpie | Vis-a-Vis | Stabilo |
| C-1 | DC-190 (0.02) | Poor | Poor | Poor |
| C-2 | DC-200 (0.02) | Poor | Poor | Poor |
| C-3 | DC-510 (0.02) | Poor | Poor | Poor |
| C-4 | DC-1248 (0.02) | Poor | Poor | Poor |
| C-5 | SF-1023 (0.02) | Poor | Poor | Poor |
| C-6 | SF-1080 (0.02) | Poor | Poor | Poor |
| C-7 | SF-1188 (0.02) | Poor | Poor | Poor |
| C-8 | L-7001 (0.02) | Poor | Poor | Poor |
| C-9 | L-7230 (0.02) | Poor | Poor | Poor |
| C-10 | FC-171 (0.02) | Fair | Poor | Poor |
| C-11 | Zonyl ® FSO-100 (0.02) | Good | Poor | Poor |
| E-1 | FC-430 (0.02) | Excellent | Good | Fair |
| E-2 | FC-431 (0.02) | Excellent | Excellent | Excellent |
| E-3 | FC-740 (0.02) | Good | Good | Good |
| E-4 | FC-740 (0.06) | Excellent | Excellent | Excellent |

The above results show that control silicones used in C-1 through C-9 as well as certain fluorinated surfactants used in C-10 and C-11 present in the receiver topcoats do not enhance receiver surface writeability. However, use of the surfactants according to the invention (E-1 through E-4) in the receiver topcoats distinctly improves surface writeability.

EXAMPLE 2

Effect of Fluorad®FC-431 surfactant on the surface writeability of receiver overcoats comprising silicone-containing copolymers.

Thermal dye transfer receiver elements were prepared as described above in Example 1. A test series was run with varying amounts of Fluorad®FC-431 in the topcoat and different percentages of polydimethylsiloxane (PDMS) units in the binder of the layer as follows:

the dye-receiving layer was overcoated with a solvent mixture of methylene chloride and trichloroethylene comprising, in different samples, a polycarbonate random terpolymer of the following composition:

1) bisphenol-A (50 mole-%), diethylene glycol (93.5 wt-%), and PDMS (6.5 wt-%), (2500 MW) block units (50 mole-%) (0.22 $g/m^2$), or 2) bisphenol-A (50 mole-%), diethylene glycol (90 wt-%), and PDMS (10 wt-%), (2500 MW) block units (50 mole-%) (0.22 $g/m^2$), or 3) bisphenol-A (50 mole-%), diethylene glycol (80 wt-%), and PDMS (20 wt-%), (2500 MW) block units (50 mole-%) (0.22 $g/m^2$), and Fluorad®FC-431 surfactant in various amounts as shown in Table; 3 below. The different thermal dye transfer receivers comprising different amounts of Fluorad®FC-431 were again subjected to the surface writeability evaluation as described in Example 1. The test results are summarized in the following Table:

TABLE 3

| Sample | wt % PDMS in Silicone-containing Copolymer | Surfactant FC-431 used in Topcoat ($g/m^2$) | Surface Writeability Evaluation Marking Pen | | |
|---|---|---|---|---|---|
| | | | Sharpie | Vis-a-Vis | Stabilo |
| C-12 | 6.5 | 0 | poor | poor | poor |
| E-5 | 6.5 | 0.0001 | poor | poor | poor |
| E-6 | 6.5 | 0.0002 | poor | poor | poor |
| E-7 | 6.5 | 0.0006 | fair | poor | poor |
| E-8 | 6.5 | 0.001 | fair | fair | fair |
| E-9 | 6.5 | 0.02 | excellent | excellent | excellent |
| C-13 | 10 | 0 | poor | poor | poor |
| E-10 | 10 | 0.002 | fair | good | good |
| C-14 | 20 | 0 | poor | poor | poor |
| E-11 | 20 | 0.0006 | poor | poor | poor |
| E-12 | 20 | 0.001 | poor | poor | poor |
| E-13 | 20 | 0.006 | fair | fair | fair |
| E-14 | 20 | 0.01 | good | good | good |

The above results show that silicone-containing copolymers as the topcoat binders without any perfluorinated surfactant result in elements of poor surface writeability ( C-12, C-13, and C-14). The E-8 sample shows that the minimum amount of perfluorinated surfactant is 0.001 $g/m^2$ in order to obtain acceptable surface writeability. While the amount of surfactant in sample E-10 is 0.002 $g/m^2$, that sample had almost twice as much PDMS silicone-containing copolymer as did sample E-8. Also, while the amount of surfactant in sample E-13 is 0.006 $g/m^2$, that sample had twice as much PDMS silicone-containing copolymer as did sample E-10.

EXAMPLE 3

Effect of Fluorad®FC-431 on Surface Writeability of Prior Art U.S. Pat. No. 5,260,257, example A1.

A subbed Oppalyte® paper support was prepared as described in Example 1. This support was overcoated with a dye-receiving layer solution prepared from a 1:1 by weight 2-butanone/toluene solvent mixture having dissolved in it a polyester resin (Vylon®200 from Toyobo KK) (2.68 $g/m^2$) and a vinyl chloride/vinyl acetate copolymer (Derika Vinyl #1000 AKT from Denki Kagaku Kogyo) (1.17 $g/m^2$). To this coating mixture was added an amino-modified silicone (KF-393 from Shinetsu Kagaku Kogyo) (0.28 $g/m^2$) and an epoxy-modified silicone (X-22-343 from Shinetsu Kagaku Kogyo) (0:28 $g/m^2$) resulting in control sample receiver C-15.

Experimental test receivers containing increasing amounts of the fluorinated alkyl ester Fluorad®FC-431 were prepared, resulting in samples containing 0.0006 to 0.02 $g/m^2$ of Fluorad®FC-431 added to the above control coating solution.

Again, the samples so prepared were subjected to surface writeability testing as described above, and the test results were summarized in the following table:

TABLE 4

| | Surfactant FC-431 (g/m²) | Surface Writeability Evaluation Marking Pen | | |
|---|---|---|---|---|
| | | Sharpie | Vis-a-Vis | Stabilo |
| C-15 | 0 | poor | poor | poor |
| E-15 | 0.0006 | poor | fair | poor |
| E-16 | 0.001 | poor | fair | poor |
| E-17 | 0.002 | fair | excellent | fair |
| E-18 | 0.006 | excellent | excellent | good |
| E-19 | 0.01 | excellent | excellent | excellent |
| E-20 | 0.02 | excellent | excellent | excellent |

The above data again confirm that improved surface writeability is obtained when suitable amounts of Fluorad®FC-431 are added to the topcoat layer of a prior art thermal dye transfer receiving layer. While the level of surfactant necessary for acceptable surface writeability is 0.002 g/m², this sample used two silicones in the overcoat which would account for more of the perfluorinated surfactant of this invention being needed to counteract the effect of the silicone.

EXAMPLE 4

Effect of Fluorad®FC-431 on Surface Writeability of Prior Art JP 61/106,293.

Dye-receiving elements as prepared in Example 3 above were overcoated with topcoat solutions prepared by adding an amino-modified silicone (KF-393 from Shinetsu Kagaku Kogyo) (0.55 g/m²) and an epoxy-modified silicone (X-22-343 from Shinetsu Kagaku Kogyo) (0.55 g/m²) in ethanol (Control Sample C-16). The experimental test samples E-21 through E-25 differed from this control sample C-16 in that they contained in addition increasing amounts of Fluorad®FC-431, ranging from 0.001 to 0.02 g/m²).

The same writeability testing was performed as done in Examples 1–3, and the test results were summarized in the following table:

TABLE 5

| Sample | Surfactant FC-431 (g/m²) | Surface Writeability Evaluation Marking Pen | | |
|---|---|---|---|---|
| | | Sharpie | Vis-a-Vis | Stabilo |
| C-16 | 0 | poor | poor | poor |
| E-21 | 0.001 | poor | poor | poor |
| E-22 | 0.002 | poor | poor | poor |
| E-23 | 0.006 | poor | poor | poor |
| E-24 | 0.01 | good | fair | fair |
| E-25 | 0.02 | good | fair | good |

The above results show that surface writeability is poor for the control receiver element C-16. When a perfluorinated surfactant according to the invention was added to the overcoat layer, a minimum of 0.01 g/m² is needed to provide a good result. However, there is much more silicone employed in this overcoat layer which would account for more of the perfluorinated suffactant of this invention being needed to counteract the effect of the silicone.

The invention has been described in detail with particular reference to preferred embodiments thereof, but it will be understood that variations and modifications can be effected within the spirit and scope of the invention.

What is claimed is:

1. A dye-receiving element comprising a support having thereon a dye image-receiving layer, the outermost layer of said dye-receiving element containing a polysiloxane and a suffactant, said surfactant consisting essentially of a perfluorinated alkyl sulfonamide ester copolymer in an amount of at least about 0.001 g/m², said perfluorinated alkyl sulfonamide ester copolymer having the following general structure:

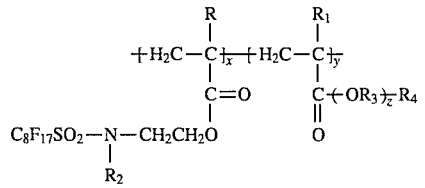

wherein:

R and $R_1$ can each independently represent hydrogen or methyl;

$R_2$ is an alkyl group having from 1 to about 6 carbon atoms;

each $R_3$ is an alkyl group having from 2 to about 4 carbon atoms;

$R_4$ is hydrogen or an alkyl group having from 1 to about 4 carbon atoms;

x is an integer of from 1 to about 5;

y is an integer of from 1 to about 5; and z is an integer of from 1 to about 25.

2. The element of claim 1 wherein said perfluorinated alkyl sulfonamide ester copolymer is located in said dye image-receiving layer.

3. The element of claim 1 wherein said perfluorinated alkyl sulfonamide ester copolymer is located in a separate layer over said dye image-receiving layer.

4. The element of claim 1 wherein R, $R_1$ and $R_4$ are each hydrogen, $R_2$ is butyl, $R_3$ is ethyl or isopropyl, and x, y and z are each 1.

5. The element of claim 1 wherein R and $R_4$ are each methyl, $R_1$ is hydrogen, $R_2$ and $R_3$ are each ethyl, x is 2, y is 1 and z is about 14.

6. A process of forming a dye transfer image comprising:

a) imagewise-heating a dye-donor element comprising a support having thereon a dye layer comprising a dye dispersed in a binder, and b) transferring a dye image to a dye-receiving dement comprising a support having thereon a dye image-receiving layer to form said dye transfer image, wherein the outermost level of said dye image-receiving element contains a polysiloxane and a surfactant, said surfactant consisting essentially of a perfluorinated alkyl sulfonamide ester copolymer in an amount of at least about 0.001 g/m², said perfluorinated alkyl sulfonamide ester copolymer having the following general structure:

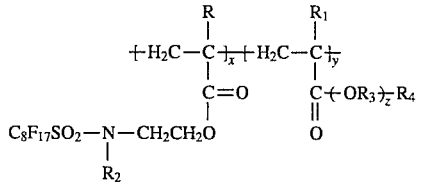

wherein:

R and $R_1$ can each independently represent hydrogen or methyl;

$R_2$ is an alkyl group having from 1 to about 6 carbon atoms;

each $R_3$ is an alkyl group having from 2 to about 4 carbon atoms;

$R_4$ is hydrogen or an alkyl group having from 1 to about 4 carbon atoms;

x is an integer of from 1 to about 5;

y is an integer of from 1 to about 5; and z is an integer of from 1 to about 25.

7. The process of claim 6 wherein said perfluorinated alkyl sulfonamide ester copolymer is located in said dye image-receiving layer.

8. The process of claim 6 wherein said perfluorinated alkyl sulfonamide ester copolymer is located in a separate layer over said dye image-receiving layer.

9. The process of claim 6 wherein R, $R_1$ and $R_4$ are each hydrogen, $R_2$ is butyl, $R_3$ is ethyl or isopropyl, and x, y and z are each 1.

10. The process of claim 6 wherein R and $R_4$ are each methyl, $R_1$ is hydrogen, $R_2$ and $R_3$ are each ethyl, x is 2, y is 1 and z is about 14.

11. A thermal dye transfer assemblage comprising:

a) a dye-donor element comprising a support having a thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye-receiving layer, wherein the outermost layer of said dye image-receiving element contains a polysiloxane and a surfactant, said surfacant consisting essentially of a perfluroromated alkyl sulfonamide ester coplymer in an amount of at least about 0.001 g/m$^2$, said perfluorinated alkyl sulfonamide ester copolymer having the following general structure:

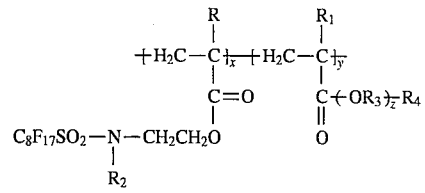

wherein:

R and $R_1$ can each independently represent hydrogen or methyl;

$R_2$ is an alkyl group having from 1 to about 6 carbon atoms;

each $R_3$ is an alkyl group having from 2 to about 4 carbon atoms;

$R_4$ is hydrogen or an alkyl group having from 1 to about 4 carbon atoms;

x is an integer of from 1 to about 5;

y is an integer of from 1 to about 5; and z is an integer of from 1 to about 25.

12. The assemblage of claim 11 wherein said perfluorinated alkyl sulfonamide ester copolymer is located in said dye image-receiving layer.

13. The assemblage of claim 11 wherein said perfluorinated alkyl sulfonamide ester copolymer is located in a separate layer over said dale image-receiving layer.

14. The assemblage of claim 11 wherein R, $R_1$ and $R_4$ are each hydrogen, $R_2$ is butyl, $R_3$ is ethyl or isopropyl, and x, y and z are each 1.

15. The assemblage of claim 11 wherein R and $R_4$ are each methyl, $R_1$ is hydrogen, $R_2$ and $R_3$ are each ethyl, x is 2, y is 1 and z is about 14.

* * * * *